US008433226B2

(12) United States Patent
Nomura

(10) Patent No.: US 8,433,226 B2
(45) Date of Patent: Apr. 30, 2013

(54) IMAGE FORMING APPARATUS AND TRANSFER DEVICE INCLUDING IMAGE CARRIER BELT AND DRIVER ROLLER

(75) Inventor: Yujiro Nomura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 358 days.

(21) Appl. No.: 12/890,144

(22) Filed: Sep. 24, 2010

(65) Prior Publication Data

US 2011/0097120 A1 Apr. 28, 2011

(30) Foreign Application Priority Data

Oct. 23, 2009 (JP) ..... 2009-244156

(51) Int. Cl.
*G03G 15/01* (2006.01)

(52) U.S. Cl.
USPC ..... 399/304

(58) Field of Classification Search ..... 399/302–304, 399/313
See application file for complete search history.

(56) References Cited

U.S. PATENT DOCUMENTS 5,745,829 A * 4/1998 Gazit et al. ..... 399/302
6,163,676 A 12/2000 Levanon et al.
6,584,294 B1 6/2003 Landa et al.
8,023,849 B2 * 9/2011 Kamijo ..... 399/304
8,145,107 B2 * 3/2012 Tanaka et al. ..... 399/304
8,254,818 B2 * 8/2012 Chiba et al. ..... 399/304
2011/0044731 A1 2/2011 Nomura et al.

FOREIGN PATENT DOCUMENTS

CN 101995795 A 3/2011
JP 2000-508280 T 7/2000
JP 2002-530722 T 9/2002
WO WO-97/09262 A1 3/1997
WO WO-00/31593 A1 6/2000

* cited by examiner

*Primary Examiner* — William J Royer
(74) *Attorney, Agent, or Firm* — Global IP Counselors, LLP

(57) ABSTRACT

An image forming apparatus including: a belt-shaped image carrier configured to carry an image; a first imaging unit configured to transfer a first image to the image carrier; a second imaging unit configured to transfer a second image to the image carrier on which the first image is transferred by the first imaging unit; a drive roller configured to circulate the image carrier by winding the image carrier thereon; a roller on which the image carrier is wound; a transfer roller having a concaved portion on part of a circumferential surface thereof which comes into abutment with the image carrier wound around the roller via a recording material; a drive unit configured to drive the transfer roller; and a gripping portion disposed in the concaved portion and configured to grip the recording material.

6 Claims, 7 Drawing Sheets

IMAGE FORMING APPARATUS AND TRANSFER DEVICE INCLUDING IMAGE CARRIER BELT AND DRIVER ROLLER

BACKGROUND

1. Technical Fields

The present invention relates to an image forming apparatus and a transfer device having a belt-shaped image carrier and a transfer roller formed with a concaved portion on a peripheral surface thereof.

2. Description of the Related Art

As an image forming apparatus configured to transfer an image formed on an image carrier to a recording material, those disclosed, for example, in JP-T-2000-508280 (for example, FIG. 1 and FIG. 2A) and JP-T-2002-530722 (for example, FIG. 4) may be exemplified. The apparatuses disclosed in these publications are the image forming apparatuses of a type which visualizes electrostatic latent images with liquid developer containing toner particles and carrier liquid, so called, a liquid-developing system. In these apparatuses, an image is transferred to the recording material by gripping the recording material with a gripper (gripping portion) provided on part of the peripheral surface of a press roller (which corresponds to a transfer roller), and feeding the recording material though a nip with respect to a drum-shaped intermediate transfer member (image carrier) while winding the same around the press roller.

In the related art described above, the image formed on a photoconductor drum is primarily transferred to the intermediate transfer member, and then is secondarily transferred to the recording material which is passed through the nip (transfer nip) formed by the press roller and the intermediate transfer member abutting each other. In this manner, in the structure in which a photosensitive member and the press roller both come into contact with the drum-shaped intermediate transfer member, vibrations or velocity fluctuations generated at the transfer nip may be transmitted to the photosensitive member and cause distortion of image when the recording material enters the transfer nip or while the recording material is passing through the transfer nip, and hence the quality of the image may be degraded. In particular, when a concaved portion for disposing the gripping portion is provided on the peripheral surface of the press roller, this problem is apparent.

SUMMARY

An advantage of some aspects of the invention is to solve the above-described problem and provide a technology to prevent distortion of images caused by passage of a recording material through a nip in an image forming apparatus and a transfer device having an image carrier and a transfer roller with a concaved portion formed on a peripheral surface thereon.

In order to solve the problems described above, an image forming apparatus according to an aspect of the invention includes: a belt-shaped image carrier configured to carry an image; a first imaging unit configured to transfer a first image to the image carrier; a second imaging unit configured to transfer a second image to the image carrier on which the first image is transferred by the first imaging unit; a drive roller configured to circulate the image carrier by winding the image carrier thereon; a roller on which the image carrier is wound; a transfer roller having a concaved portion on part of a circumferential surface thereof which comes into abutment with the image carrier wound around the roller via a recording material; a drive unit configured to drive the transfer roller; and a gripping portion disposed in the concaved portion and configured to grip the recording material.

In the specification, an expression "the circumferential surface of the transfer roller and the image carrier come into abutment with each other" includes not only a case where they come into direct contact with each other, but also a case where the recording material passing through the transfer nip formed by the circumferential surface of the transfer roller and the image carrier is interposed therebetween. That is, the circumferential surface of the transfer roller comes into abutment with the image carrier via the recording material.

In the invention configured as described above, since the belt-shaped image carrier is employed, influence of the vibrations or velocity fluctuations generated when the recording material passes through the nip formed by the image carrier and the transfer roller abutting each other is alleviated in comparison with the case where the drum-shaped image carrier is employed. In contrast, since the concaved portion where the gripping portion is disposed is provided on the circumferential surface of the transfer roller, the image carrier is subject to the vibrations with the rotation of the transfer roller. In particular, since the image carrier is circulated, if the roller opposing the transfer roller driven by the drive unit is driven, the load of the roller significantly varies according to the rotational phase of the transfer roller or whether or not the recording material passes therethrough, so that the velocity variations of the image carrier often occur.

Therefore, according to an aspect of the invention, the image carrier on which the first and second images are transferred by the first and second imaging units is wound around the drive roller, so that the image carrier after having transferred image thereto is driven and fed to the position of abutment with the transfer roller. The drive roller which circulates the image carrier is different from the roller abutting the transfer roller and having the image carrier wound thereon. Therefore, the velocity fluctuations occurring on the image carrier is restrained. The vibrations generated on the image carrier at the position of abutment with the transfer roller are eliminated by winding the image carrier around the drive roller, and are prevented from affecting the image transfer to the image carrier by the first and second imaging units. In this configuration, according to an aspect of the invention, image distortion caused by passage of the recording material through the position of abutment between the image carrier and the transfer roller or the presence of the concaved portion on the transfer roller are prevented. In particular, displacement of the images formed on the image carrier by the plurality of imaging units from each other is effectively prevented.

As described above, according to an aspect of the invention, a configuration in which the image carrier after having transferred the image thereon is wound around the drive roller and driven, and then fed to the position of abutment with the transfer roller is employed. In other words, the drive roller is disposed at a position where the image carrier having the second image transferred thereon is wound and the roller has the image carrier wound thereon at a position where the image carrier wound around the drive roller and driven thereby is wound. In other words, the position where the images are transferred by the first and second imaging units, the position where the drive roller is wound, and the position where the roller opposing the transfer roller is wound are arranged along the direction of movement of the image carrier in this order. According to an aspect of the invention, the vibrations generated in the image carrier are prevented from affecting the image transfer by the first and second imaging units by winding the image carrier on the drive roller between the position where the images from the first and second imaging units are transferred and the position where the image is transferred to the recording material.

According to an aspect of the invention, the circumferential length of the circumferential surface of the transfer roller other than the concaved portion may be longer than the length of the recording material in the direction of transport, and a pressing member configured to press the roller having the image carrier wound thereon toward the transfer roller may be provided. By pressing the roller toward the transfer roller, a high pressing force is applied on the recording material passing between the image carrier and the transfer roller, so that the image transfer efficiency can be enhanced. In addition, by setting the circumferential length of the circumferential surface of the transfer roller other than the concaved portion to be longer than the length of the recording material along the direction of transport of printing material which passes between the image carrier and the transfer roller, a constant pressing force can be applied to the recording material while the printing material passes therethrough.

The transfer roller having the longer circumferential length than the length of the recording material is larger in diameter consequently, while the roller for winding the image carrier may be the one having the small diameter. Therefore, obtaining the pressing force by pressing the roller having the small diameter is realistic in structure than providing a pressing member to the drive roller which is large in diameter and weight, and vibrations caused by the movement of the roller may be reduced. In this configuration, swinging a revolving shaft of the transfer roller is no longer necessary, and hence a configuration of a mechanism for transmitting a drive force from the drive unit to the transfer roller can be simplified.

When the width of the nip of the opening of the concaved portion in the direction of rotation of the transfer roller is larger than the width of the nip of the transfer nip formed by the circumferential surface of the transfer roller coming into abutment with the image carrier via the recording material in the direction of rotation of the transfer roller, a regulating member which regulates the distance between the transfer roller and the image carrier when the concaved portion opposes the image carrier may be provided. In the configuration in which the transfer roller having the concaved portion having an opening wider than the width of the nip of the transfer nip and the image carrier come into abutment with each other, the distance between the transfer roller and the image carrier may be different between the state in which the transfer nip is formed because the circumferential surface other than the concaved portion is pressed by the image carrier and the state in which the transfer nip is released because the concaved portion faces the image carrier. In particular, in the structure having the pressing member as described above, this problem is obvious, and significant vibrations may be generated. In such a case, the generation of the vibrations may be restrained by maintaining the distance between the image carrier and the transfer roller constant by providing the regulating member which regulates the distance between the transfer roller and the image carrier when the concaved portion opposes the image carrier.

A tension roller configured to adjust a tension of the image carrier by coming into abutment with the image carrier between a position where the image carrier is wound around the drive roller and a position where the image carrier is wound around the roller may be provided. In this configuration, since the vibrations generated on the image carrier at the position of abutment with the transfer roller and reaches the position where the drive roller is wound is attenuated by the tension roller, the vibrations are prevented from affecting the image transfer to the image carrier by the first and second imaging units further reliably.

The direction of extension of the image carrier wound around the roller on the upstream side in the direction of movement of the image carrier may be configured to match or schematically match the direction of a tangential line on the surface of the transfer roller at the position of abutment between the transfer roller and the image carrier. In other words, the image carrier may be extended in the direction of the tangential line of the transfer roller at the position of abutment or in the direction substantially the same on the upstream side in the direction of movement of the image carrier viewed from the position of abutment between the transfer roller and the image carrier. In this configuration, the image carrier is fed to the position of abutment with the transfer roller while maintaining a substantially planer state, and hence the image on the image carrier is transferred to the recording material without distortion caused by bending of the image carrier, whereby the quality of the image can further be improved.

In order to solve the above-described problem, a transfer device according to an aspect of the invention includes: a belt-shaped image carrier to which an image is transferred; a drive roller configured to circulate the image carrier by winding the image carrier having the image transferred thereto; a first imaging unit configured to transfer a first image to the image carrier; a roller on which the image carrier driven by the drive roller is wound; a transfer roller having a concaved portion on part of the circumferential surface thereof which comes into abutment with and drives the image carrier wound around the roller via a recording material; and a gripping portion disposed in the concaved portion and configured to grip the recording material to which the image is transferred. According to an aspect of the invention configured as described above, the vibrations generated in the image carrier are prevented from affecting the image transfer to the image carrier in the same manner as the image forming apparatus described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
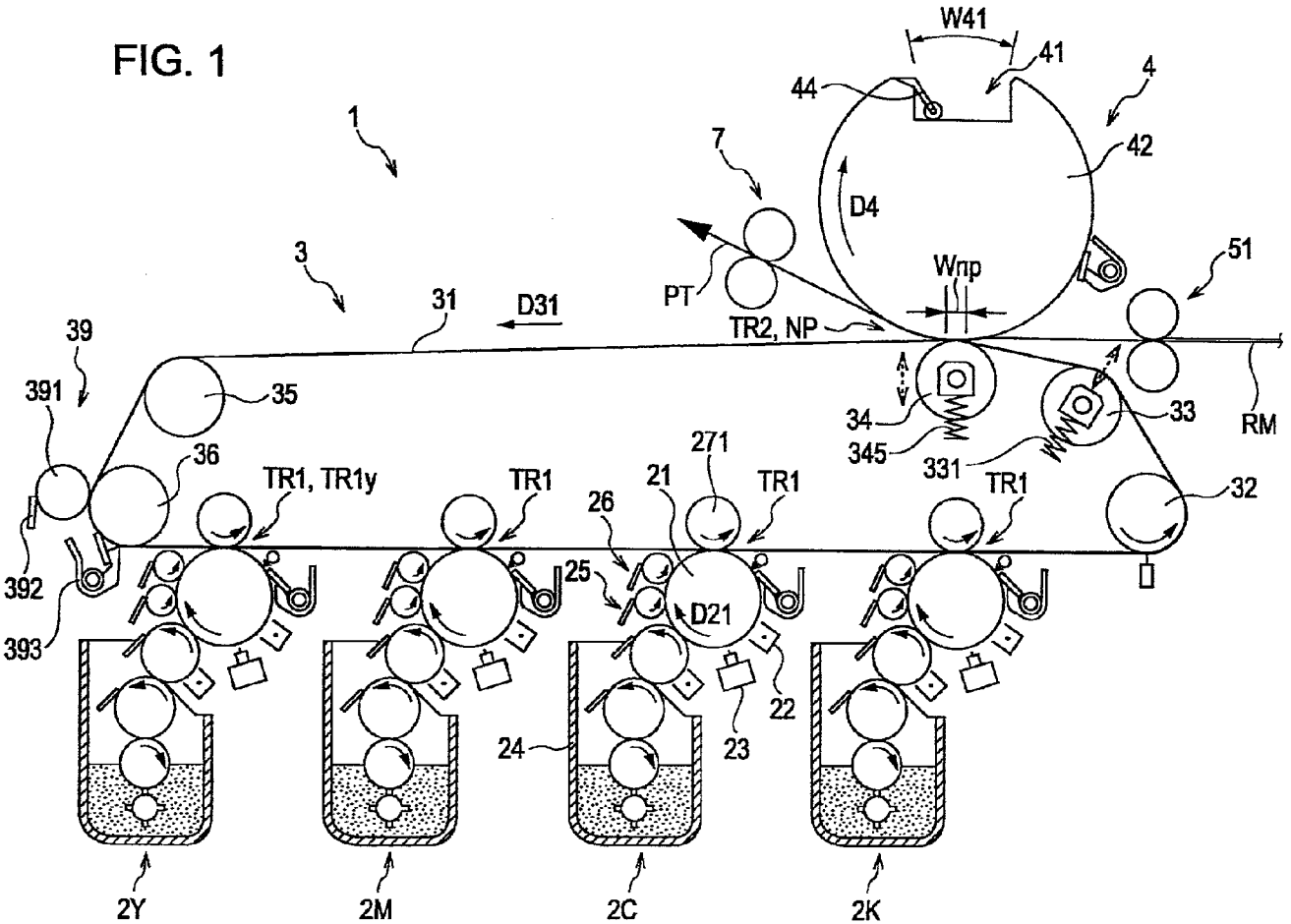
FIG. 1 is a drawing showing an image forming apparatus according to a first embodiment of the invention.
Figure 2:
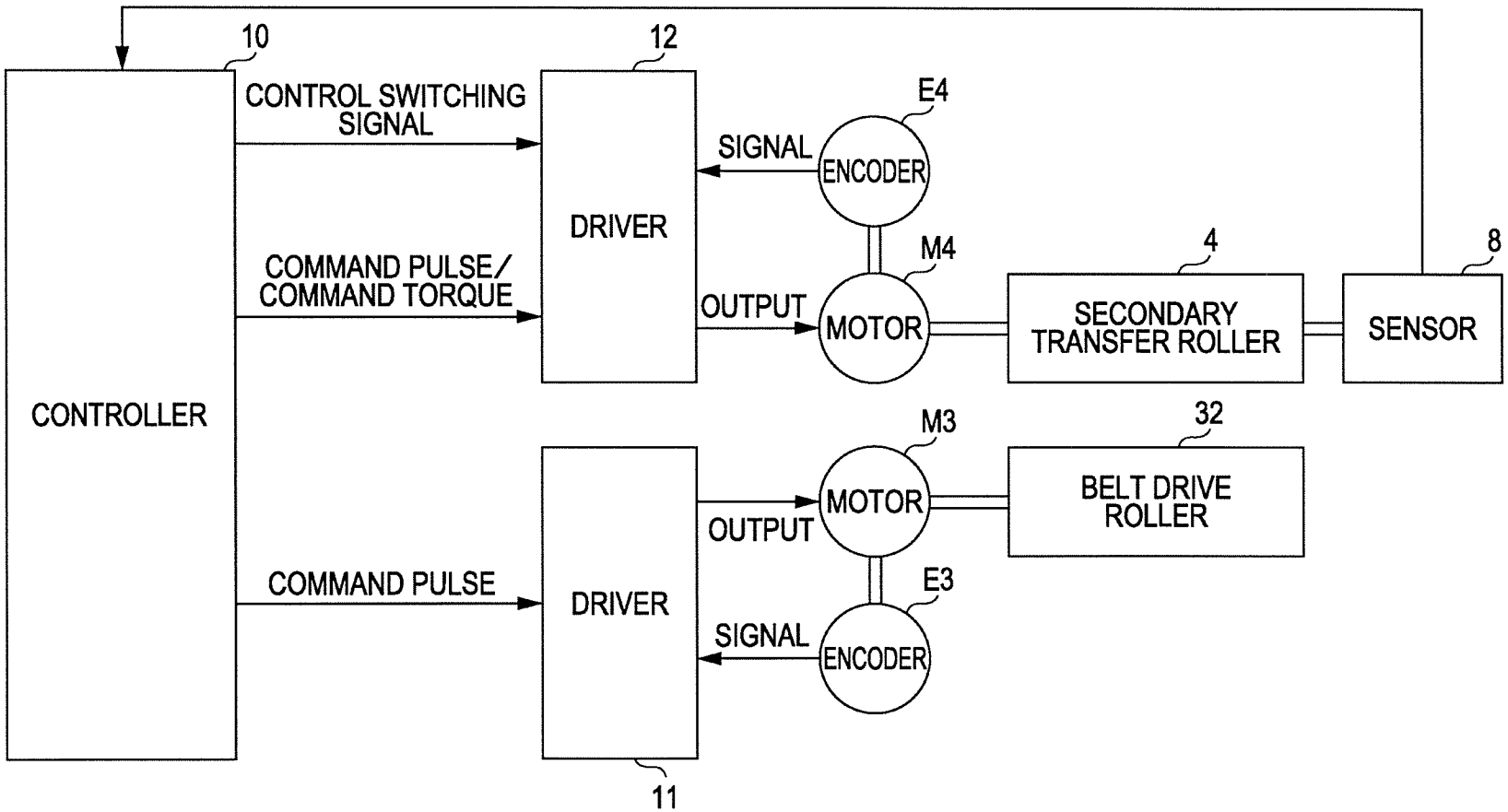
FIG. 2 is a block diagram showing an electric configuration of the image forming apparatus shown in FIG. 1.

FIG. 1 is a drawing showing an image forming apparatus 1 according to a first embodiment of the present invention. FIG. 2 is a block diagram showing an electric configuration of the image forming apparatus 1 shown in FIG. 1. The image forming apparatus 1 includes four image forming stations 2Y (for yellow), 2M (for magenta), 2C (for cyan), and 2K (for black) which form a plurality of images in different colors. Then, the image forming apparatus 1 is capable of being selectively operated in a color mode in which four colors of toner of yellow (Y), magenta (M) cyan (C), and black (K), are overlapped to form a color image and in a monochrome mode in which only the black (K) toner is used to form a monochrome image. In this image forming apparatus 1, when an image formation command is given to a controller 10 having a CPU and a memory from an external device such as a host computer, the controller 10 controls respective portions of the apparatus 1 and performs predetermined image forming actions, whereby an image corresponding to the image formation command is formed on a sheet-shaped recording material RM such as copy paper, transfer paper, sheet, and OHP transparent sheet.

The image forming stations 2Y, 2M, 2C and 2K all have the same structure and the same functions except for toner colors. Therefore, in FIG. 1, reference sign and numerals are assigned only to components which constitute the image forming station 2C, and reference signs and numerals to be assigned to other image forming stations 2Y, 2M, and 2K are omitted for easy understanding of the drawing. In the description given below, the structure and the action of the image forming station 2C will be described with reference to the signs and numerals assigned in FIG. 1. However, the structures and the actions of the image forming stations 2Y, 2M and 2K are the same except for the difference in toner color.

The image forming station 2C is provided with a photoconductor drums 21 on which a toner image of the cyan color is formed on the surface thereof. The photoconductor drum 21 is arranged in such a manner that an axis of rotation thereof is arranged in parallel to or substantially parallel to the primary scanning direction (the direction vertical to a paper plane of FIG. 1), and is driven to rotate at a predetermined velocity in the direction indicted by an arrow D21 in FIG. 1.

Around the photoconductor drum 21, a charger 22 as a corona charger configured to charge the surface of the photoconductor drum 21 to a predetermined potential, an exposure unit 23 configured to expose the surface of the photoconductor drum 21 according to an image signal to form an electrostatic latent image, a developing unit 24 configured to visualize the electrostatic latent image as a toner image, a first squeezing portion 25, a second squeezing portion 26, a primary transfer unit configured to primarily transfer the toner image to an intermediate transfer belt 31 of a transfer unit 3, a cleaning unit configured to perform cleaning of the surface of the photoconductor drum 21 after the transfer, and a cleaner blade are disposed in this order along the direction of rotation D21 of the photoconductor drum 21 (clockwise in FIG. 1).

The charger 22 does not come into contact with the surface of the photoconductor drum 21, and a corona charger typically used in the related art may be used as the charger 22. When a scorotron charger is used as the corona charger, negative wire current is flowed in a charge wire of the scorotron charger, and a DC grid charge bias is applied on a grid. By the photoconductor drum 21 charged with corona discharge by the charger 22, the potential of the surface of the photoconductor drum 21 is set to a substantially uniform potential.

The exposure unit 23 exposes the surface of the photoconductor drum 21 by a light beam according to the image signal supplied from the external device and forms an electrostatic latent image corresponding to the image signal. The exposure unit 23 may be configured to cause the light beam from a semiconductor laser to scan using a polygon mirror in the primary scanning direction or may be composed of a line head or the like having light emitting elements arranged in the primary scanning direction.

Toner is supplied from the developing unit 24 to the electrostatic latent image formed in this manner, and the electrostatic latent image is developed by the toner. In the developing unit 24 of the image forming apparatus 1, toner development is performed using liquid developer containing substantially 20% weight ratio of toner dispersed in carrier liquid. In this image forming apparatus 1, instead of low concentration (1 to 2 wt %) and low viscosity volatile liquid developer having volatility at room temperatures and containing Isoper (Trade Mark: Exxon) as carrier liquid, a high viscosity (on the order of 30 to 10000 pa·s) liquid developer obtained by adding solid particles of about 1 μm in average particle diameter including a coloring agent such as pigment dispersed into a high concentration and high viscosity resin having non-volatility at room temperatures into a liquid solvent such as organic solvent, silicone oil, mineral oil or edible oil together with a dispersing agent to have a toner solid content concentration of about 20% is used.

The first squeezing portion 25 and the second squeezing portion 26 include squeezing rollers, respectively. Then, the respective squeezing rollers come into contact with the surface of the photoconductor drum 21 to remove excessive carrier liquid or fogged toner of the toner image. Although the excessive carrier liquid and fogged toner are removed by the first and second squeezing portions 25 and 26 in this embodiment, the number and arrangement of the squeezing portions are not limited thereto and, for example, arrangement of only one squeezing portion is also applicable.

The toner image having passed through the first and second squeezing portions 25 and 26 is primarily transferred to the intermediate transfer belt 31 by the primary transfer unit. The intermediate transfer belt 31 is an endless belt as an image carrier which is capable of carrying a toner image temporarily on the surface, more specifically, on the outer peripheral surface thereof, and is wound around a plurality of rollers 32, 33, 34, 35, and 36. The roller 32 among others is mechanically connected to a belt drive motor M3, and functions as a belt drive roller which circulates the intermediate transfer belt 31 in the direction indicated by an arrow D31 in FIG. 1. As shown in FIG. 2, the image forming apparatus 1 includes a driver 11 for driving the belt drive motor M3, and the driver 11 outputs drive signals according to command pulses given from the controller 10 to the belt drive motor M3. Accordingly, the belt drive roller 32 rotates at a circumferential velocity corresponding to the command pulse, and the surface of the intermediate transfer belt 31 circulates in the direction D31 at a constant velocity. The reference symbol E3 in the same drawing denotes an encoder mounted on the belt drive motor M3, which issues signals corresponding to the rotation of the belt drive motor M3 to the driver 11, and the driver 11 having received this signal controls to feedback the belt drive motor M3 on the basis of the above-described signals.

Although the detailed description will be given below, the roller which is driven by the motor is only the above-described belt drive roller 32 from among the rollers 32 to 36 on which the intermediate transfer belt 31 is wound, and other rollers 33 to 36 are driven rollers which do not have a drive source. The intermediate transfer belt 31 is wound around the belt drive roller 32 on the downstream side of a primary transfer position TR1 and the upstream side of a secondary transfer position TR2, described later, in the direction of belt movement D31.

The primary transfer unit includes a primary transfer backup roller 271, and the primary transfer backup roller 271 is disposed so as to oppose the photoconductor drum 21 with the intermediary of the intermediate transfer belt 31 therebetween. At the primary transfer position TR1 where the photosensitive drum 21 and the intermediate transfer belt 31 come into abutment with each other, the toner image on the photoconductor drum 21 is transferred to the outer peripheral surface of the intermediate transfer belt 31 (lower surface at the primary transfer position TR1). In this manner, a toner image of Cyan formed by the image forming station 2C is transferred to the intermediate transfer belt 31. In the same manner, by performing transfer of the toner images by other image forming stations 2Y, 2M, and 2K as well, the toner images of the respective colors are superimposed on the intermediate transfer belt 31 in sequence, so that a full color toner image is formed. In contrast, when a monochrome toner image is formed, the toner image transfer to the intermediate transfer belt 31 is performed only in the image forming station 2K which corresponds to Black.

The toner image transferred to the intermediate transfer belt 31 passes though a wound position of the belt drive roller 32 and is transported to the secondary transfer position TR2. At the secondary transfer position TR2, a secondary transfer roller 4 is arranged so as to oppose the roller 34 on which the intermediate transfer belt 31 is wound with the intermediary of the intermediate transfer belt 31, so that the surface of the intermediate transfer belt 31 and the surface of the secondary transfer roller 4 come into abutment with each other to form a transfer nip NP. In other words, the roller 34 functions as a secondary transfer backup roller. A revolving shaft of the backup roller 34 is supported elastically by a pressing unit 345, which is an elastic member such as a spring, so as to be capable of moving toward and away from the intermediate transfer belt 31.

At the secondary transfer position TR2, a toner image made of a single color or a plurality of colors formed on the intermediate transfer belt 31 is transferred to the recording material RM transported from a pair of gate rollers 51 along a transporting path PT. In this embodiment, since the toner image is formed by a wet developing system in which the toner image is formed by using the liquid developer, it is desired to press the recording material RM against the intermediate transfer belt 31 at a high pressing force at the transfer nip NP in order to obtain preferable transfer characteristics. Since the liquid developer is interposed therebetween, it is highly possible that the recording material RM sticks to the intermediate transfer belt 31 and causes a jam. Therefore, in the image forming apparatus 1, the secondary transfer roller 4 having a gripping portion is employed as described later in detail.

The recording material RM on which the toner image is secondarily transferred is fed from the secondary transfer roller 4 to a fixing unit 7 provided on the transporting path PT. In the fixing unit 7, heat or pressure is applied to the toner images transferred to the recording material RM to fix the toner image on the recording material RM.

Figure 3A:
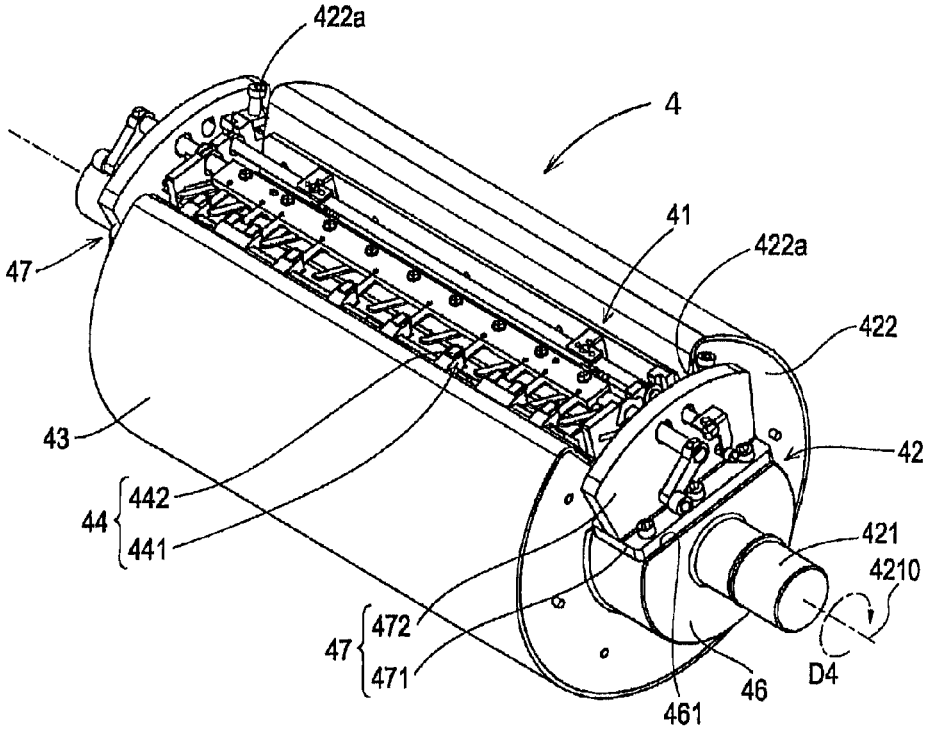
FIGS. 3A and 3B are drawings showing a configuration of a secondary transfer roller.
Figure 3B:
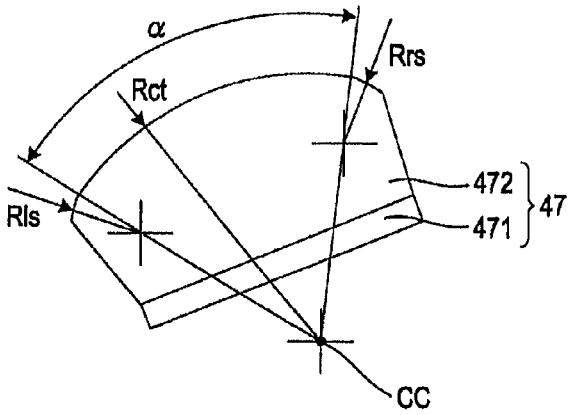

FIGS. 3A and 3B are drawings showing a configuration of the secondary transfer roller 4. More specifically, FIG. 3A is a perspective view showing a general configuration of the secondary transfer roller 4, and FIG. 3B is a drawing for explaining the shape of an angular contact member 47. As shown in FIG. 1 and FIG. 3A, the secondary transfer roller 4 includes a roller base material 42 provided with a concaved portion 41 formed by notching part of the outer peripheral surface of a cylinder. In the roller base material 42, a revolving shaft 421, which is rotatable in the direction D4, is arranged at the center of an axis of rotation 4210 in parallel or in substantially parallel to the revolving shaft of the secondary transfer backup roller 34.

Side panels 422 are attached to both ends of the revolving shaft 421, respectively. More specifically, the side panels 422 each are a disk-shaped metallic plate having a notched portion 422*a* formed thereon. Then, as shown in FIG. 3A, the notched portions 422*a* are attached to the revolving shaft 421 opposed to each other at a distance slightly longer than the width of the intermediate transfer belt 31. In this manner, the roller base material 42 having a drum shape as a whole, and including the concaved portion 41 on part of the outer peripheral surface so as to extend in parallel or in substantially parallel to the revolving shaft 421 is formed.

In addition, an elastic layer 43 such as rubber or resin is formed on the outer peripheral surface of the roller base material 42, that is on a surface area of the metallic plate except for an area corresponding to the interior of the concaved portion 41. The elastic layer 43 opposes the intermediate transfer belt 31 wound around the backup roller 34 to form the transfer nip NP. At the transfer nip NP, the backup roller 34 is pressed toward the secondary transfer roller 4 by the pressing unit 345, so that a predetermined load (60 kgf in this embodiment) is applied to the transfer nip NP formed between the secondary transfer roller 4 and the intermediate transfer belt 31 wound around the backup roller 34.

A gripping portion 44 for griping the recording material RM is disposed in the interior of the concaved portion 41. The gripping portion 44 includes a gripper supporting member 441 provided so as to extend upright from an inner bottom portion of the concaved portion 41 to the outer peripheral surface of the roller base material 42, and a gripper member 442 supported so as to come into and out of contact with a distal end portion of the gripper supporting member 441. The gripper member 442 is connected to a gripper drive unit (not shown). Then, by the operation of the gripper drive unit upon receipt of an ungrip command from the controller 10, a distal end portion of the gripper member 442 is moved away from the distal end portion of the gripper supporting member 441 for being ready for gripping the recording material RM or releasing the grip. In contrast, by the operation of the gripper drive unit upon receipt of a grip command from the controller 10, the distal end portion of the gripper member 442 is moved to the distal end portion of the gripper supporting member 441 to grip the recording material RM. The configuration of the gripping portion 44 is not limited to the embodiment and other gripping mechanisms which are known in the related art can be employed.

Supporting members 46 are attached to outside surfaces of the respective side panels 422 at both ends of the secondary transfer roller 4 so as to be rotatable integrally with the roller base material 42. The supporting members 46 each include a plane area 461 corresponding to the concaved portion 41. Then, angular contact members 47 on the side of the secondary transfer roller 4 are attached respectively to the plane areas 461. The angular contact members 47 are configured in such a manner that a base portion 471 is attached to the supporting member 46, and the portion from the base portion 471 to an angular contact portion 472 extends in the normal direction in the plane area 461, and the distal end of the angular contact portion 472 extends to a position in the vicinity of an end portion on the opening side of the concaved portion 41. In other words, when viewing the roller base material 42 from the end of the revolving shaft 421, the angular contact member 47 is arranged so as to close the concaved portion 41. Therefore, when the concaved portion 41 reaches a position opposing the intermediate transfer belt 31 by the rotation of the secondary transfer roller 4, the angular contact member 47 comes into abutment with a surface of the end portion of the secondary transfer backup roller 34.

As shown in FIG. 3B, a peripheral surface of the distal end portion of the each angular contact portion 472 is formed so as to have a radius of curvature Rct at the center portion of the peripheral surface on the distal end side, which is larger than those of Rrs and Rls at both end portions. For example, in this embodiment, the outer diameter of the roller base material 42 including the elastic layer 43 is set to approximately 191 mm, while the radius of curvature Rct is set to 88.2 mm, and those of Rrs and Rls at both ends are set to 22.4 mm. The center of curvature CC at the center portion of the angular contact member 47 is arranged at an axis of rotation of the roller base material 42, that is, the axis of rotation 4210 of the revolving shaft 421, and an angular range $\alpha$ at the center portion is set to be 63° which is slightly wider than a range of opening (60°) of the concaved portion 41. Therefore, when the secondary transfer roller 4 is rotated, the concaved portion 41 opposes the intermediate transfer belt 31 wound around the drive roller 32 across the angular range $\alpha$.

Also, an opening length (opening width) W41 of the concaved portion 41 along the direction of rotation D4 of the roller base material 42 is;

$$191\times\pi\times(60/360)\approx100 \text{ mm}.$$

In contrast, in an angular range $\beta$ (=360°−60°), an elastic layer 43 opposes the intermediate transfer belt 31 to form the transfer nip NP as described below, and the length of the elastic layer 43 along the direction of rotation D4 of the roller base material 42 is set to;

$$191\times\pi\times\{(300/360)\approx500 \text{ mm}.$$

This is for allowing the recording material RM having the longest usable size to be wound in the image forming apparatus 1. In other words, the length of the elastic layer 43 is determined so as to be longer than the longest usable recording material RM in the direction of rotation D4 of the roller base material 42.

In this embodiment, the length of the transfer nip NP (nip width) Wnp along the direction of rotation D4 of the roller base material 42 is about 11 mm, and has a relation;

(opening width W41 of concaved portion 41)>(nip width Wnp at the transfer nip NP).

Therefore, in the state in which the concaved portion 41 of the secondary transfer roller 4 opposes the intermediate transfer belt 31, the transfer nip NP is temporarily disappeared.

From this reason, and since the secondary transfer backup roller 34 is configured to be movable toward and away from the secondary transfer roller 4, the secondary transfer backup roller 34 might be displaced toward the secondary transfer roller 4 in the state in which the concaved portion 41 of the secondary transfer roller 4 opposes the intermediate transfer belt 31. The angular contact members 47 have a function to restrain the displacement of the secondary transfer backup roller 34 as described above.

Figure 4A:
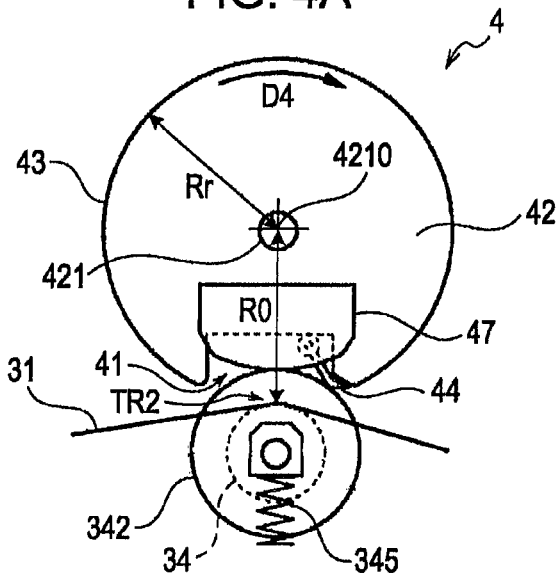
FIG. 4A and FIG. 4B are drawings for explaining an operation of an angular contact member according to the embodiment.
Figure 4B:
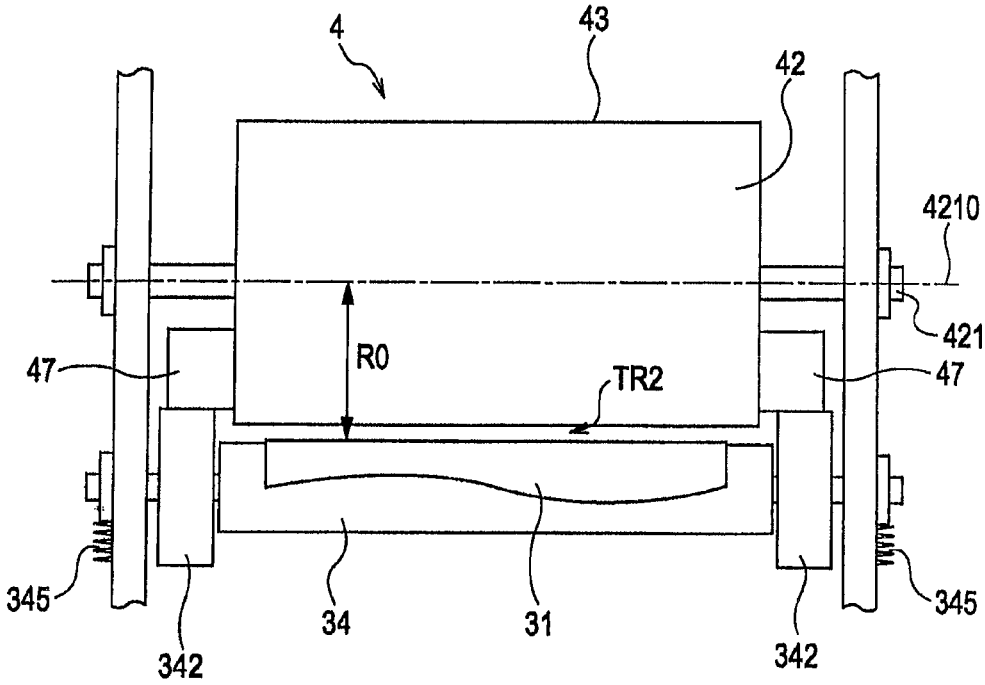

FIGS. 4A and 4B are drawings for explaining an action of the angular contact member 47 according to the embodiment. More specifically, FIG. 4A is a drawing of the angular contact member 47 when the concaved portion 41 faces the secondary transfer position TR2 when viewed in the axial direction, and FIG. 4B is a drawing of the same viewed in the direction orthogonal to the axial direction. As shown in FIG. 4A, outer peripheral surfaces of the angular contact members 47 each have a substantially arcuate shape having a center of curvature arranged at the axis of rotation 4210 of the secondary transfer roller 4 in an area facing the concaved portion 41 of the secondary transfer roller 4. In contrast, bearings 342 each having a larger diameter than that of the secondary transfer backup roller 34 are provided at the ends of the secondary transfer backup roller 34 so as to be rotatable coaxially with the secondary transfer backup roller 34 and independently therefrom. When the angular contact members 47 of the secondary transfer roller 4 face the secondary transfer backup roller 34, the outer peripheral surfaces of the angular contact members 47 and the outer peripheral surfaces of the bearings 342 come into abutment with each other, and regulates the distance between the axis of rotation 4210 of the secondary transfer roller 4 and the surface of the intermediate transfer belt 31 against a pressing force of the pressing unit 345.

A distance R0 from the axis of rotation 4210 of the secondary transfer roller 4 to the intermediate transfer belt 31 when the concaved portion 41 is positioned at the secondary transfer position TR2 and the angular contact members 47 are in abutment with the bearings 342 is set to be slightly smaller than a radius Rr of the secondary transfer roller 4 having the elastic layer 43 formed thereon. More precisely, the distance R0 is set to be the same as the distance between the axis of rotation 4210 of the secondary transfer roller 4 and the intermediate transfer belt 31 in the state in which the transfer nip NP is formed at the secondary transfer position TR2. When the transfer nip NP is formed, the elastic layer 43 is elastically deformed by the pressing force applied from the pressing unit 345. Therefore, the distance between the axis of rotation 4210 of the secondary transfer roller 4 and the intermediate transfer belt 31 is slightly smaller than the radius Rr of the secondary transfer roller 4 in the state in which no pressing force is applied thereto. The distance between the axis of rotation 4210 of the secondary transfer roller 4 and the intermediate transfer belt 31 in this state, that is, in the state in which the transfer nip NP is formed is R0. Therefore, in this embodiment, the distance between the axis of rotation 4210 of the secondary transfer roller 4 and the intermediate transfer belt 31 is maintained to a substantially constant value R0 irrespective of the rotational phase of the secondary transfer roller 4.

A transfer roller drive motor M4 is mechanically connected to the revolving shaft 421 of the secondary transfer roller 4. In this embodiment, a driver 12 is provided for driving the transfer roller drive motor M4. The driver 12 drives the motor M4 according to commands given by the controller 10 and rotates the secondary transfer roller 4 in the clockwise direction D4 in FIG. 1, that is, in the same direction as the direction D31 of belt movement. The secondary transfer backup roller 34 is a driven roller having in itself no drive source. By configuring the secondary transfer backup roller 34 which opposes the secondary transfer roller 4 driven by the motor M4 as the driven roller, slippage is prevented from occurring between the secondary transfer roller 4 and the intermediate transfer belt 31 at the transfer nip NP, or between the intermediate transfer belt 31 and the secondary transfer backup roller 34.

In this embodiment, an AC servomotor is used as the motor M4, and the AC servomotor is configured to be controlled in position and torque by the driver 12. In other words, the driver 12 includes a position control circuit and a torque control circuit, and is capable of selectively executing the positional control and the torque control. The controller 10 is capable of outputting command pulses relating to the positional information, torque command signals relating to the torque information, and control switching signals to the driver 12.

The reference symbol E4 in FIG. 2 denotes an encoder mounted on the transfer roller drive motor M4, which issues signals corresponding to the rotation of the transfer roller drive motor M4 to the driver 12, and the driver 12 having received this signal controls to feedback the motor M4 on the basis of the above-described signals. The reference numeral 8 denotes a phase detection sensor connected to one of the ends of the revolving shaft 421 of the secondary transfer roller 4, and the controller 10 is capable of detecting the rotational phase of the secondary transfer roller 4 on the basis of the output of the phase detection sensor 8.

Referring back to FIG. 1, the description of the configuration of the image forming apparatus 1 will be continued. From among the rollers 32-36 on which the intermediate transfer belt 31 is wound, the driven roller 33 provided between the belt drive roller 32 and the secondary transfer backup roller 34, that is, on the downstream side of the position of the belt drive roller 32 where the intermediate transfer belt 31 is wound and the upstream side of the position of the secondary transfer backup roller 34 where the intermediate transfer belt 31 is wound in the direction of belt movement D31, is a tension roller whose revolving shaft is supported elastically by a spring 331 to adjust the tension of the intermediate transfer belt 31. More specifically, the revolving shaft of the tension roller 33 is elastically supported by the spring 331 which is capable of expanding and contracting in the direction substantially orthogonal to an imaginary plane which comes into contact with both the outer peripheral surface of the belt drive roller 32 and the outer peripheral surface of the secondary transfer backup roller 34, whereby the tension roller 33 is free to move by a predetermined amount in the same direction in the state in which the intermediate transfer belt 31 is wound. Then, in the stationary state, the tension roller 33 is pressed by the spring 331 in the direction to push the intermediate transfer belt 31 extending between the belt drive roller 32 and the secondary transfer backup roller 34 outward.

In the secondary transfer position TR2, the load torque of the belt drive motor M3 which drives the belt drive roller 32 fluctuates significantly when the surface of the secondary transfer roller 4 opposing the intermediate transfer belt 31 changes from the elastic layer 43 to the concaved portion 41 or, on the contrary, from the concaved portion 41 to the elastic layer 43 with the rotation of the secondary transfer roller 4. When a high pressing force is applied between the elastic layer 43 and the intermediate transfer belt 31, the magnitude of the fluctuation is larger. Accordingly, velocity variations or vibrations of the intermediate transfer belt 31 are caused, so that the tension of the intermediate transfer belt 31 may be changed temporarily.

However, in this embodiment, the revolving shaft of the tension roller 33 provided between the belt drive roller 32 at the position where the intermediate transfer belt 31 is wound and the secondary transfer position TR2 is moved along the direction of extension of the intermediate transfer belt 31 to cancel the variations of the tension. Therefore, the velocity variations or the vibrations of the intermediate transfer belt 31 at the secondary transfer position TR2 are prevented from affecting the primary transfer positions TR1 corresponding to the respective image forming stations 2Y, 2M, 2C and 2K. The velocity variations and the vibrations of the intermediate transfer belt 31 at the primary transfer position TR1 cause distortion of the toner images transferred from the image forming stations 2Y, 2M, 2C, and 2K and degrade the image quality. For example, when the toner images of respective colors are superimposed at positions deviated from each other, it causes color drift. However, in this embodiment, such effects on the image formation are prevented.

The tension roller 33 is in abutment with the intermediate transfer belt 31 from the inside of the intermediate transfer belt 31, that is, from the back side of the surface of the intermediate transfer belt 31, which is the surface opposite from an image carrying surface. The reasons are as follows. First of all, with the abutment on the opposite side from the image carrying surface, the tension roller 33 does not cause the distortion of the toner images carried on the intermediate transfer belt 31 or, in contrast, the tension roller 33 is prevented from being contaminated by toner or the like which remains on the intermediate transfer belt 31. In order to improve the effect of adjustment of the tension generated by the tension roller 33, it is effective to secure a large winding angle of the intermediate transfer belt 31. However, in order to cause the tension roller 33 to come into abutment with the image carrying surface and in addition, to increase the winding angle, it is necessary to provide a negative large curvature to the surface of the intermediate transfer belt 31, which causes concerns of influence on the toner images, and also there is a structural problem. From these reasons, the tension roller 33 is configured to come into abutment with the back surface of the intermediate transfer belt 31.

A belt cleaning unit 39 is provided so as to oppose the roller 36, which is one of rollers 35, 36 provided on the downstream side of the secondary transfer position TR2 in the direction of transport D31 of the intermediate transfer belt 31. More specifically, the belt cleaning unit 39 includes a belt cleaning roller 391 configured to come into abutment with the surface of the intermediate transfer belt 31 wound around the roller 36 to remove substances adhered thereto such as residual carrier liquid or toner, and a blade 392 configured to scrape the substances adhered to the belt cleaning roller 391. In addition, a belt cleaning blade 393 configured to be capable of coming into and out of contact with the intermediate transfer belt 31 for finally removing the residual substances that the belt cleaning roller 391 fails to remove is provided at a position downstream of the belt cleaning roller 391.

A bias potential of a negative polarity, which is an opposite polarity of the charged polarity of the toner (positive polarity), for example, a negative potential on the order of (−400) to (−600) V is applied to the belt cleaning roller 391. With the action of the potential, the belt cleaning roller 391 electrostatically adsorbs the positively charged toner, which is not transferred to the recording material RM at the secondary transfer position TR2 and remains on the intermediate transfer belt 31.

Figure 5:
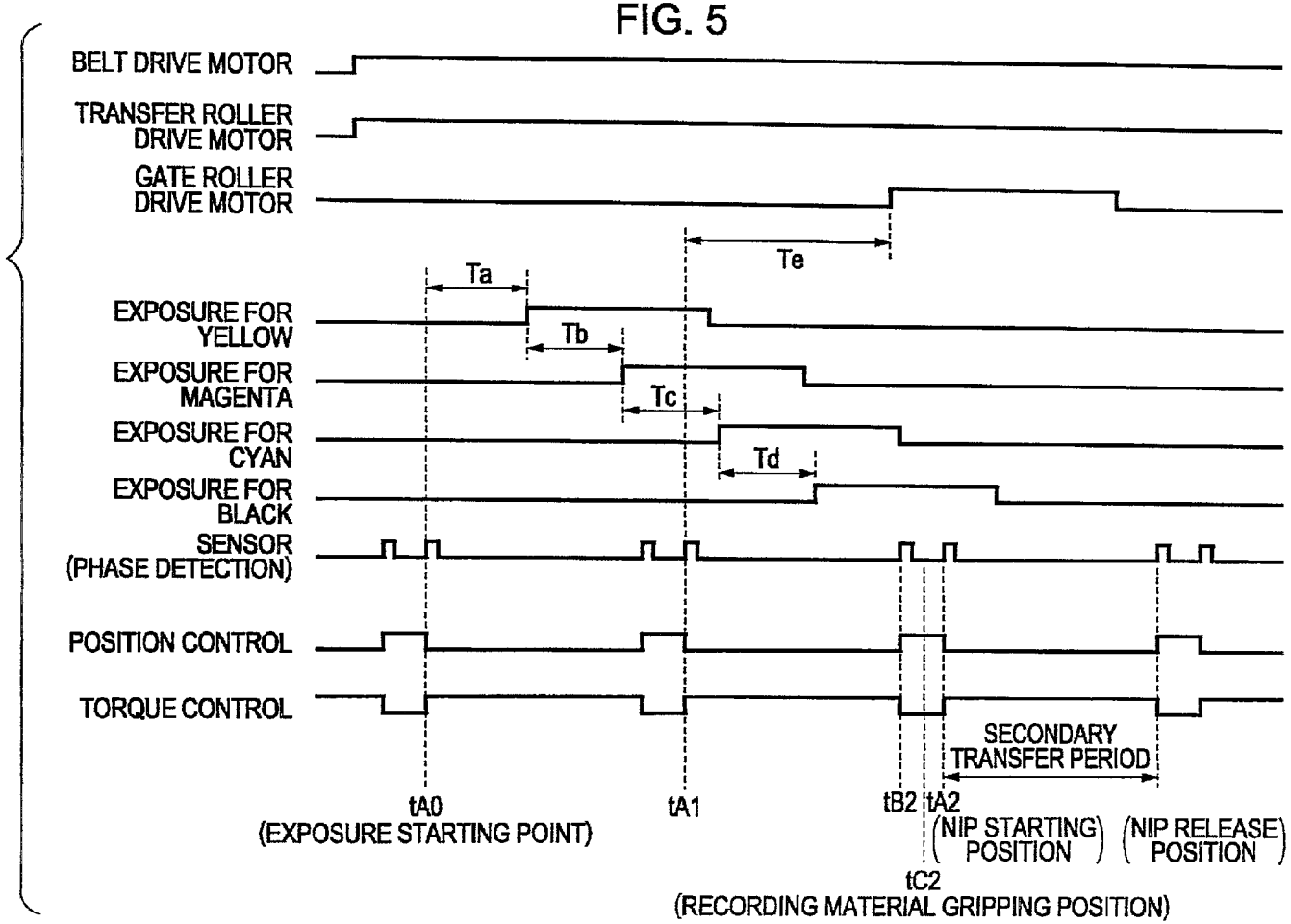
FIG. 5 is a timing chart showing an example of the action of the image forming apparatus shown in FIG. 1.

Subsequently, referring to FIG. 5 and FIGS. 6A-6F, an action of the image forming apparatus 1 configured as described above will be described. FIG. 5 is a timing chart showing an example of the action of the image forming apparatus 1 shown in FIG. 1. FIGS. 6A-6F is a drawing schematically showing the action of the image forming apparatus 1 shown in FIG. 1. In the image forming apparatus 1, when the image formation command which instructs the formation of the color image is applied to the controller 10 from the external apparatus such as the host computer, the controller 10 controls the respective portions of the image forming apparatus 1 according to a program stored in a memory, not shown. First of all, the belt drive motor M3 and the transfer roller drive motor M4 are operated to move the intermediate transfer belt 31 and the secondary transfer roller 4 respectively.

The phase detection sensor 8 (FIG. 2) provided on the secondary transfer roller 4 outputs high-level signals temporarily when the surface of the secondary transfer roller 4 opposing the intermediate transfer belt 31 at the secondary transfer position TR2 changes from the cylindrical peripheral surface having the elastic layer 43 to the concaved portion 41, and when it changes from the concaved portion 41 to the elastic layer 43, respectively. The controller 10 switches the mode of the drive control of the secondary transfer roller 4, which is driven by the driver 12, between the position control and the torque control alternately on the basis of the change in signal level. More specifically, the position control is performed when the concaved portion 41 of the secondary transfer roller 4 opposes the intermediate transfer belt 31, and the torque control is performed when the transfer nip NP is formed with the elastic layer 43 opposing the intermediate transfer belt 31. The position control is constantly performed for the belt drive motor M3, and the surface of the intermediate transfer belt 31 circulates at a predetermined velocity.

When the output of the phase detection sensor 8 is changed at a timing tA0 and the portion of the secondary transfer roller 4 facing the secondary transfer position TR2 is changed from the concaved portion 41 to the elastic layer 43 and hence the transfer nip NP is formed, the controller 10 switches the drive control mode of the driver 12 to the torque control by the control switching signal and provides the torque command signals to the driver 12 to perform the torque control for the secondary transfer roller 4. From the timing tA0 as an exposure start point, the toner images are formed in the respective image forming stations 2Y, 2M, 2C and 2K, where the toner images are primarily transferred to the surface of the intermediate transfer belt 31.

In other words, as shown in FIG. 5, when a time Ta is elapsed from the timing tA0, latent image formation by the exposure unit 23 is started in the image forming station 2Y on the basis of the respective signals from the controller 10, and a toner image of yellow is formed. When a time Tb is elapsed from the start of an exposure for yellow, an exposure for magenta is started. When a time Tc is elapsed from the start of the exposure for magenta, an exposure for cyan is started. When a time Td is elapsed from the start of the exposure for cyan, an exposure for black is started. In this manner, the toner images of the respective colors are formed, and are superimposed on the intermediate transfer belt 31 in sequence, so that a full-colored toner image TI is formed on the surface of the intermediate transfer belt 31.

Figure 6A:
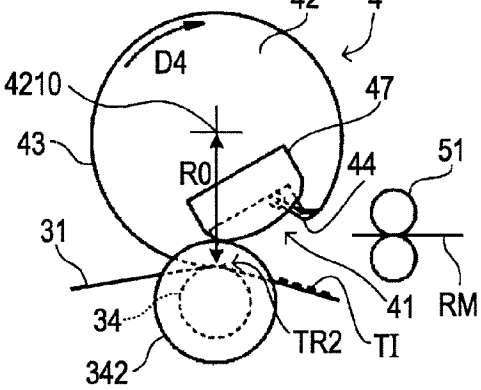
FIGS. 6A to 6F are drawings schematically showing actions of the image forming apparatus shown in FIG. 1.

While the toner images of the respective colors are formed, the secondary transfer roller 4 makes another turn in the direction D4, and the transfer nip NP once released is formed again. When a predetermined time Te is elapsed from a corresponding timing tA1, the controller 10 outputs a command pulse to a driver (not shown) which controls a gate roller drive motor (not shown) connected to the gate rollers 51 to operate the gate roller drive motor. Accordingly, the transport of the recording material RM to the secondary transfer position TR2 is started (FIG. 6A).

Figure 6B:
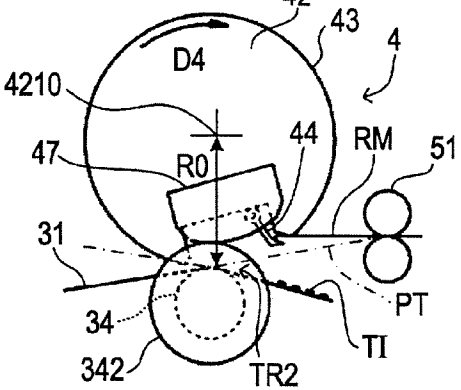

When the portion of the secondary transfer roller 4 facing the secondary transfer position TR2 is changed to the concaved portion 41 and the transfer nip NP is released, the controller 10 switches the drive control mode of the driver 12 from the torque control to the position control by the control switching signal, and issues a command pulse to the driver 12 at a corresponding timing tB2. Accordingly, the secondary transfer roller 4 rotates in the direction of rotation D4 and the concaved portion 41 moves to a predetermined recording material gripping position (FIG. 6B). The distal end portion of the gripper member 442 is moved away from the distal end portion of the gripper supporting member 441, so that the preparation for gripping the recording material RM is completed. Then, the leading end of the recording material RM fed by the gate rollers 51 enters between the gripper member 442 and the gripper supporting member 441, and then a paper gripping action is started (FIG. 6B). Here, this action is called "paper gripping action" for the convenience of description, the recording material RM is not limited to the paper as described before.

Figure 6C:
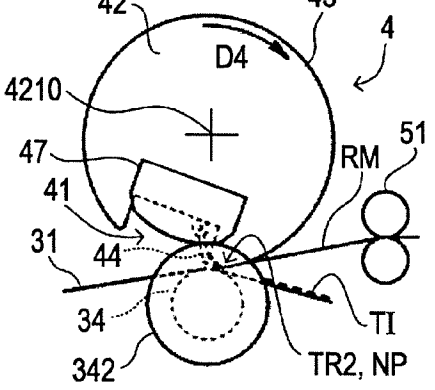

The controller 10 issues a grip command to a gripper drive unit (not shown) simultaneously or slightly behind the timing tB2. Upon receipt of the grip command, the gripper drive unit is operated, and the distal end portion of the gripper member 442 is moved to the distal end portion of the gripper supporting member 441. Accordingly, the leading end of the recording material RM is gripped, and the "paper gripping action" is completed (FIG. 6C). At the timing when the "paper gripping action" is completed, as shown in FIG. 6C, the toner image TI is positioned on the upstream side of the secondary transfer position TR2 in the direction of movement D31 of the surface of the intermediate transfer belt 31.

Figure 6D:
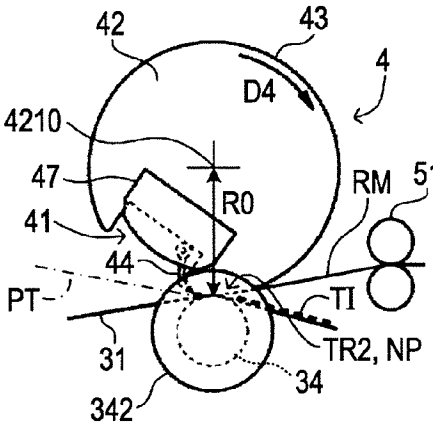

In this manner, the recording material RM is transported in the direction of rotation D4 together with the secondary transfer roller 4 in a state of being gripped by the gripping portion 44 at the leading end thereof. Then, at the timing tA2, when the elastic layer 43 on the surface of the secondary transfer roller 4 reaches the secondary transfer position TR2 and the transfer nip NP is started to be formed, the recording material RM is pinched by the transfer nip NP formed between the elastic layer 43 of the secondary transfer roller 4 and the surface of the intermediate transfer belt 31, and is transported with the rotation thereof. Accordingly, the secondary transfer of the toner image TI formed on the intermediate transfer belt 31 to a lower surface (front surface) of the recording material RM is started (FIG. 6D). At this timing tA2, the controller 10 switches the drive control mode from the driver control 12 to the torque by the control switching signal and issues the torque command signals to the driver 12 to perform the torque control for the secondary transfer roller 4.

Figure 6E:
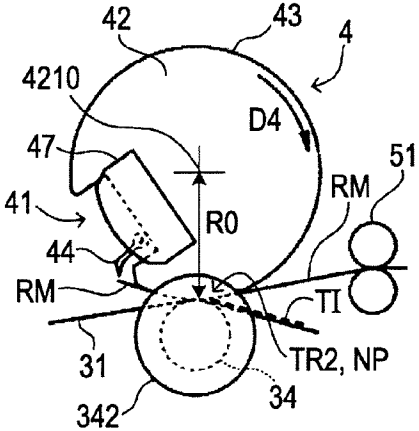
Figure 6F:
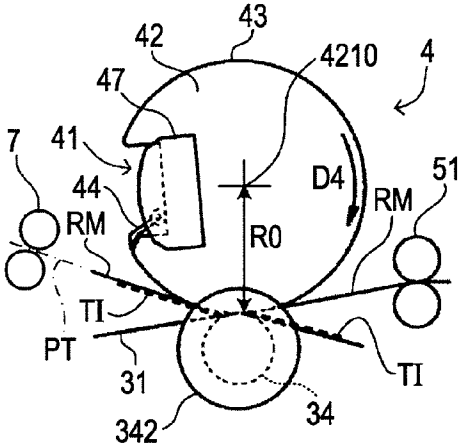

The secondary transfer roller 4 rotates in the direction of rotation D4 under the torque control, so that the recording material RM passes between the transfer nip NP in the state of being gripped by the gripping portion 44 at the leading end thereof to proceed the secondary transfer of the toner image TI. Then, when the gripping portion 44 moves to a position in the vicinity of the upstream'end of the fixing unit 7 (the end on the right side in FIG. 1), the leading end of the recording material RM held by the gripping portion 44 is moved sufficiently away from the intermediate transfer belt 31 and is transported to an entrance of the fixing unit 7. As shown in FIG. 6E, the controller 10 issues a release command to the gripper drive unit at a timing when the gripping portion 44 is moved to the vicinity of the upstream end of the fixing unit 7 to move the distal end portion of the gripper member 442 away from the distal end portion of the gripper supporting member 441 thereby releasing the grip of the recording material RM. Accordingly, the leading end of the recording material RM is reliably fed into the fixing unit 7 without being adhered to the surface of the intermediate transfer belt 31 (FIG. 6F). Then, the fixation of the color toner image TI onto the recording material RM is performed by the fixing unit 7. After the release, the leading end of the recording material RM is transported toward the fixing unit 7 along the transport path PT, and the secondary transfer process is performed while the trailing end of the recording material RM is pinched and transported by the transfer nip NP formed between the elastic layer 43 of the secondary transfer roller 4 and the intermediate transfer belt 31.

In this manner, in the embodiment, the images formed in the plurality of image forming stations 2Y, 2M, 2C and 2K are transferred primarily to and superimposed on the intermediate transfer belt 31 wound around the plurality of rollers 32 to 36, and the images are then transferred secondarily to the recording material RM by causing the recording material RM to pass through the transfer nip NP formed by bringing the secondary transfer roller 4 into abutment with the intermediate transfer belt 31 at a position different from the image forming positions (that is, the primary transfer position TR1) of these image forming stations 2Y, 2M, 2C, and 2K.

During this operation, the distance between the axis of rotation 4210 of the secondary transfer roller 4 and the intermediate transfer belt 31 is maintained at the substantially constant value R0. At the timing when the surface of the secondary transfer roller 4 positioned at the secondary transfer position TR2 is switched from the concaved portion 41 to the elastic layer 43 or, in contrast, from the elastic layer 43 to the concaved portion 41, and the timing when the trailing end of the recording material RM passes through the transfer nip NP, the secondary transfer roller 4 comes into abutment with different surfaces. When the surface of the secondary transfer roller 4, which is positioned at the secondary transfer position TR2, changes from the concaved portion 41 to the elastic layer 43, a torque, which causing the elastic layer 43 to deform elastically, is required in addition to the torque for rotating the secondary transfer roller 4. In contrast, when it changes from the elastic layer 43 to the concaved portion 41, the torque for deforming the elastic layer 43 is not necessary. Therefore, fluctuations in load torque of the secondary transfer roller drive motor M4 may not be avoided.

From the intermediate transfer belt 31 standpoint, while the elastic layer 43 of the secondary transfer roller 4 is in abutment with the surface thereof, the drive force of the secondary transfer roller drive motor M4 is transferred indirectly via the secondary transfer roller 4. In contrast, when the concaved portion 41 of the secondary transfer roller 4 opposes thereto, the transfer of this force is interrupted. From these reasons, there may arise vibrations in the intermediate transfer belt 31 wound around the plurality of rollers 32 to 36 at the respective timings described above. Once such vibrations are transferred to the primary transfer position TR1, the image formed there may be distorted.

In particular, when the secondary transfer backup roller 34 at the position opposing the secondary transfer roller 4 is the drive roller for circulating intermediate transfer belt 31, it may cause slippage or vibrations of the intermediate transfer belt 31 even with a slight velocity difference between the secondary transfer roller 4 and the secondary transfer backup roller 34 (more precisely, difference in circumferential velocity between the surfaces of the secondary transfer roller 4 and the intermediate transfer belt 31). Since the elastic layer 43 provided on the surface of the secondary transfer roller 4 and the intermediate transfer belt 31 itself are elastically deformed, it is extremely difficult to completely eliminate the difference in circumferential velocity between the secondary transfer roller 4 and the intermediate transfer belt 31.

When the secondary transfer roller 4 and the backup roller 34 opposed to each other are driven independently, they may interfere with respect to each other, or slippage may occur between the secondary transfer roller 4 and the intermediate transfer belt 31. Velocity variations caused by difference in coefficient of friction may also occur whether the recording material RM is present at the transfer nip NP or not. In contrast, such problems can be avoided by using belt drive rollers for the rollers other than the backup roller. Therefore, in this embodiment, the driven roller is used as the secondary transfer backup roller 34, and the belt drive roller is used as the roller 32 different therefrom.

The vibrations of the intermediate transfer belt 31 generated at the secondary transfer position TR2 can be suppressed by winding the intermediate transfer belt 31 around the belt drive roller 32 between the primary transfer position TR1 and the secondary transfer position TR2, so that the vibrations are prevented from being transferred to the primary transfer position TR1. In other words, the belt drive roller 32 driven by the drive motor M3 also has a function to eliminate the vibrations generated at the secondary transfer position TR2.

In this embodiment, the revolving shaft 421 of the secondary transfer roller 4 is fixed and, in contrast, the revolving shaft of the secondary transfer backup roller 34 is pressed toward the secondary transfer roller 4. Accordingly, an impact applied when the surface of the secondary transfer roller 4 which is in abutment with the intermediate transfer belt 31 changes between the concaved portion 41 and the elastic layer 43 or when the recording material RM leaves the transfer nip NP can be absorbed by the displacement of the secondary transfer backup roller 34.

The impact can also be absorbed by swinging the revolving shaft 421 of the secondary transfer roller 4 instead of the backup roller 34 in principle. However, the secondary transfer roller 4 needs to have a circumferential length longer than the length of the recording material RM, it is large and hence inevitably heavy. Therefore, displacing such heavy components may cause vibrations in the entire image forming apparatus 1. In addition, it is also necessary to connect a mechanism for transferring the drive force of the motor. From these reasons, it is unrealistic to swing the revolving shaft 421 of the secondary transfer roller 4.

In contrast, suppression of large-scaled vibrations as described above is achieved by swinging the revolving shaft of the secondary transfer backup roller 34, which is a driven roller whose diameter can be reduced without constrains in terms of dimensions and having no driving mechanism.

In the configuration in which a drum-type intermediate transfer member is employed as in the related art described before, the transfer roller and the intermediate transfer drum are both large and the vibrations of the intermediate transfer drum directly affect the image formation. Therefore, such configuration cannot be employed.

In the configuration of the embodiment in which the revolving shaft of the secondary transfer backup roller 34 is swung, the swinging movement of the secondary transfer backup roller 34 may directly vibrates the intermediate transfer belt 31. In this embodiment, the vibrations are eliminated by bringing the belt drive roller 32 into abutment with the intermediate transfer belt 31 between the primary transfer position TR1 and the secondary transfer position TR2 and, in addition, the tension roller 33 is brought into abutment with the intermediate transfer belt 31 between the position where the intermediate transfer belt 31 is wound around the belt drive roller 32 and the secondary transfer position TR2, so that the vibrations at the secondary transfer position TR2 are fundamentally prevented from being transferred to the position where the intermediate transfer belt 31 is wound around the belt drive roller 32.

On the downstream side of the secondary transfer position TR2 in the direction of belt movement D31, vibrations are eliminated by securing the circumferential length of the intermediate transfer belt 31 to the primary transfer position TRly, which corresponds to the image forming station 2Y located at the most upstream stream, to be long enough and the two driven rollers 35 and 36 are provided therebetween.

Figure 7:
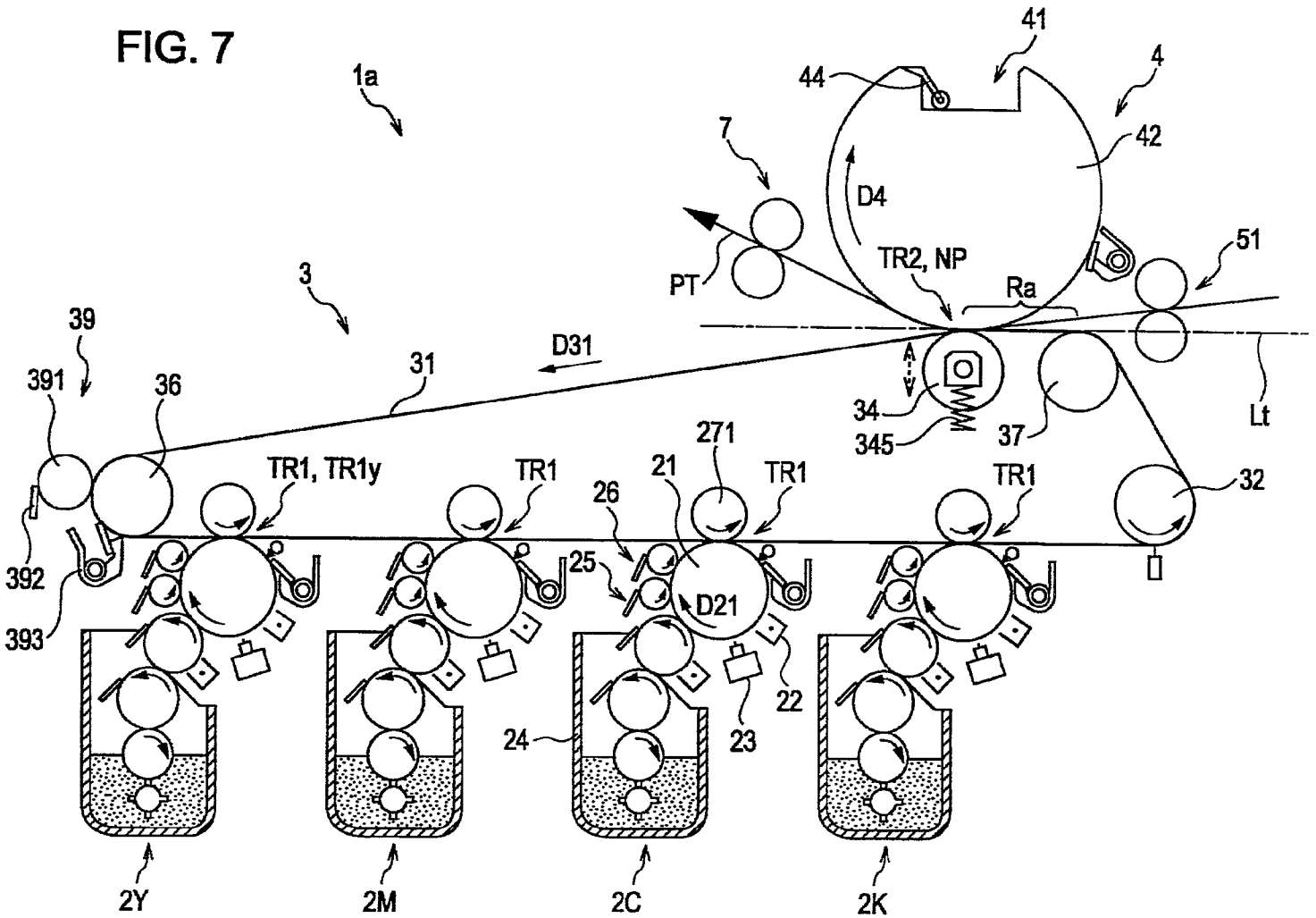
FIG. 7 is a drawing showing an image forming apparatus according to a second embodiment of the invention.

Referring now to FIG. 7, a second embodiment of the image forming apparatus 1 according to an aspect of the invention will be described. The image forming apparatus 1*a* in the second embodiment is significantly different from that in the first embodiment in the following two points as described later. However, the basic configurations and actions except for these points are the same. Therefore, in the following description, characteristics of the second embodiment different from those of the first embodiment are mainly described. The configurations which are the same as those of the first embodiment are denoted by the same reference numerals and signs, and the detailed description thereof will be omitted.

FIG. 7 is a drawing showing the second embodiment of the image forming apparatus 1*a* according to an aspect of the invention. A first characteristic of the image forming apparatus 1*a* in this embodiment is different from that in the first embodiment in that the driven roller 35 provided on the downstream side of the primary transfer position TR1 in the first embodiment is omitted. A second characteristic is in that a normal driven roller 37 is provided between the position where the intermediate transfer belt 31 is wound around the belt drive roller 32 and the secondary transfer position TR2 instead of the tension roller 33 and, in addition, the position where it is disposed is changed.

The roller 37 is disposed in such a manner that the direction of extension of the intermediate transfer belt 31 on the upstream side of the transfer nip NP in the direction of the belt transport D31 matches, or substantially matches the direction of a tangential line Lt of the circumferential surface of the secondary transfer roller 4 at the transfer nip NP, in particular, at the upstream end. In other words, a plane formed by the surface of the intermediate transfer belt 31 in a range Ra between the position wound around the roller 37 and the position wound around the secondary transfer backup roller 34 matches, or substantially matches, the tangential plane of the circumferential surface of the secondary transfer roller 4 at the upstream end of the transfer nip NP. The position where the driven roller 37 is disposed is set to achieve the relationship as described above.

In this configuration, the intermediate transfer belt 31 is fed into the transfer nip NP while maintaining the substantially planer state, and hence the toner image carried on the intermediate transfer belt 31 is prevented from being distorted due to bending of the intermediate transfer belt 31. Therefore, transfer of the toner image without distortion can be transferred to the recording material RM, and hence the image quality on the recording material RM can further be improved.

In contrast, from the viewpoint of securing the amount of the intermediate transfer belt 31 to be wound around the secondary transfer backup roller 34 to be enough for applying a sufficient pressure to the recording material RM passing through the transfer nip NP, it is necessary to set the direction of extension of the intermediate transfer belt 31 on the downstream side of the secondary transfer position TR2 to be as far from the secondary transfer roller 4 as possible, and hence the roller corresponding to the driven roller 35 in the first embodiment is omitted.

In this configuration, in addition to the effects of the first embodiment described above, the improvement of the image quality as described above is achieved. In the configuration shown in FIG. 7, the direction of extension of the intermediate transfer belt 31 on the upstream side of the transfer nip NP in the direction of belt transport D31 is set to be substantially horizontal. However, this is not an indispensable condition.

As described above, in the respective embodiments, while the intermediate transfer belt 31 functions as the "image carrier", the secondary transfer roller 4 functions as the "transfer roller". The belt drive roller 32 and the secondary transfer backup roller 34 function as the "drive roller" and the "roller", respectively. The transfer roller drive motor M4 functions as the "drive unit". The image forming stations 2Y, 2M, 2C, and 2K function as the "first and second imaging units".

In these embodiments, the gripping portion 44 functions as the "gripping portion", and the tension roller 33 in the first embodiment functions as the "tension roller". In these embodiments, while the pressing portion functions as the "pressing portion", the angular contact member 47 functions as the "regulating member".

The invention is not limited to the above-described embodiments, and various modifications may be made without departing the scope of the invention. For example, while the tension roller 33 is the tension roller in the first embodiment, the roller 37 is the normal driven roller other than the tension roller. However, the roller 33 in the first embodiment may be the roller other than the tension roller and the roller 37 in the second embodiment may be the tension roller. The driven rollers 35 and 36 may also be the tension rollers as needed.

In the embodiments described above, the four image forming stations 2Y, 2M, 2C, and 2K are arranged in one row along the direction of extension of the intermediate transfer belt 31. However, the number or the arrangement of the image forming stations is not limited thereto, and the invention can be applied generally to the image forming apparatuses having two or more image forming stations.

In the embodiments described above, the intermediate transfer belt 31, the belt drive roller 32, the secondary transfer backup roller 34, the secondary transfer roller 4, and the tension rollers 33 and 35 integrally constitute the transfer unit 3, which is the "transfer device" in the invention. In this case, including the drive source which drives the transfer roller or the drive roller in the transfer unit is not indispensable. For example, it is also possible to configure the motor fixed to the apparatus body to engage the transfer roller or the drive roller and hence functions as the drive source when the transfer unit is mounted.

In addition, in the embodiments described above, the image forming apparatus employs the developer having toner dispersed in the liquid carrier, which is a so-called a liquid developing system. However, the object to which the invention is applied is not limited to those of the above-described system. In other words, irrespective of the developing system, the invention is applicable generally to the image forming apparatuses having a structure to bring the transfer roller whose circumferential surface is partly notched into abutment with the intermediate transfer belt as shown in FIG. 1.

The entire disclosure of Japanese Patent Application No: 2009-244156, filed Oct. 23, 2009 is expressly incorporated by reference herein.

What is claimed is:

1. An image forming apparatus comprising:

an image carrier belt that carries an image;

a first imaging unit that transfers a first image to the image carrier belt;

a second imaging unit that transfers a second image to the image carrier belt on which the first image is transferred by the first imaging unit;

a drive roller on which the image carrier belt is wound and that circulates the image carrier belt;

a roller on which the image carrier belt is wound;

a transfer roller having a concaved portion on part of a circumferential surface thereof that contacts with the image carrier belt wound around the roller via a recording material;

a drive unit that drives the transfer roller; and a gripping portion disposed in the concaved portion and that grips the recording material.

2. The image forming apparatus according to claim 1, wherein the drive roller is disposed at a position where the image carrier belt having the second image transferred thereon is wound;

the roller is disposed at a position where the image carrier belt driven by being wound around the drive roller is wound.

3. The image forming apparatus according to claim 1, wherein a circumferential length of the circumferential surface of the transfer roller other than the concaved portion is longer than a length of the recording material in a direction of transport, and a pressing member that presses the roller toward the transfer roller is provided.

4. The image forming apparatus according to claim 1, wherein a width of an opening of the concaved portion in the direction of rotation of the transfer roller is wider than a width of a nip of a transfer nip in the direction of rotation of the transfer roller formed by contacting the circumferential surface of the transfer roller and the image carrier belt via the recording material, and a regulating member that regulates a distance between the transfer roller and the image carrier belt when the concaved portion opposes the image carrier belt.

5. The image forming apparatus according to claim 1, comprising a tension roller that contacts with the image carrier belt between a position where the image carrier belt is wound around the drive roller and a position where the image carrier belt is wound around the roller and that adjusts a tension of the image carrier belt.

6. A transfer device comprising:

an image carrier belt to which an image is transferred;

a drive roller on which the image carrier belt having the image transferred is wound and that circulates the image carrier belt;

a roller on which the image carrier belt driven by the drive roller is wound;

a transfer roller having a concaved portion on part of a circumferential surface thereof which contacts with the image carrier belt wound around the roller via a recording material; and a gripping portion disposed in the concaved portion and that grips the recording material.

* * * * *